US005613547A

United States Patent [19]

Lauener

[11] Patent Number: 5,613,547

[45] Date of Patent: Mar. 25, 1997

[54] NOZZLE WITH A BAFFLE FOR A CASTER AND AN ASSOCIATED METHOD OF CASTING MOLTEN METAL

[75] Inventor: Wilhelm F. Lauener, Gerlafingen/SO, Switzerland

[73] Assignee: Larex A.G., Solothurn, Switzerland

[21] Appl. No.: 567,180

[22] Filed: Jan. 11, 1996

[51] Int. Cl.[6] ..... B22D 41/50

[52] U.S. Cl. ..... 164/437; 222/591; 222/606

[58] Field of Search ..... 164/437, 434, 164/438, 488, 439, 440, 431, 432; 222/606, 607, 591

[56] References Cited

U.S. PATENT DOCUMENTS

| | | | |
|---|---|---|---|
| 3,774,670 | 11/1973 | Gyongyos . | |
| 4,290,477 | 9/1981 | Huber et al. . | |
| 4,485,835 | 12/1984 | Huber et al. . | |
| 4,550,766 | 11/1985 | Ai et al. . | |
| 4,550,767 | 11/1985 | Yu et al. . | |
| 4,619,309 | 10/1986 | Huber et al. . | |
| 4,785,873 | 11/1988 | Lauener . | |
| 4,794,978 | 1/1989 | Lauener . | |
| 4,798,315 | 1/1989 | Lauener | 222/591 |
| 4,915,270 | 4/1990 | Dainel et al. | 222/606 |
| 4,949,776 | 8/1990 | Takasugi et al. | 222/591 |
| 4,964,456 | 10/1990 | Lauener . | |
| 5,435,375 | 7/1995 | Eckert | 164/437 |

FOREIGN PATENT DOCUMENTS

| | | | |
|---|---|---|---|
| 864035 | 6/1978 | Belgium . | |
| 63-183759 | 7/1988 | Japan | 164/437 |

OTHER PUBLICATIONS

The Mat 2 Pages Date Unknown Tepax, Inc.
Power Mounts 1 Page Date Unknown Tepax, Inc.
Power Mounts 4 Pages Date Unknown Dennsion.
Tach–It 1 Page Date Unknown Ben Clements & Sons, Inc.

*Primary Examiner*—Kuang Y. Lin
*Attorney, Agent, or Firm*—David V. Radack; Eckert Seamans Cherin & Mellott

[57] ABSTRACT

A nozzle for a caster defining a mold for casting molten metal into a metal product. The nozzle includes a mouthpiece portion for introducing the molten metal from the nozzle into the mold and further includes a baffle having a portion thereof disposed in the mouthpiece portion and a portion thereof extending into the mold. An associated method of casting a molten metal in a mold of a caster is also disclosed.

16 Claims, 4 Drawing Sheets

NOZZLE WITH A BAFFLE FOR A CASTER AND AN ASSOCIATED METHOD OF CASTING MOLTEN METAL

BACKGROUND OF THE INVENTION

This invention relates to an improved nozzle for a caster and an associated method of casting molten metal and more particularly to a nozzle including a baffle to create smooth laminar flow of the molten metal through the nozzle and into the mold of the caster.

Casters for casting a molten metal into a metal product are well known. One type of a caster is a vertical twin belt continuous casting machine, such as that disclosed in U.S. Pat. No. 4,964,456. These vertical twin belt casters include a tundish which receives molten metal from a furnace, the molten metal being subsequently fed to a nozzle. The molten metal flows through the nozzle and into a mold which is formed by a pair of opposed movable belts and a pair of opposed side dams. The molten metal solidifies in the mold and emerges as a cast metal product which is subsequently moved out of the mold at casting speed.

One of the main functions of the nozzle is to introduce the molten metal into the mold in a quiescent state. Ideally, there should be a smooth laminar flow of molten metal in the nozzle, with no turbulence. Furthermore, the molten metal should be distributed evenly across the width of the slab or strip to be cast. A smooth laminar flow with minimal turbulence will resist recirculation of the molten metal at the nozzle opening thus resisting freezing of the molten metal to the tip of the nozzle. What is needed, therefore, is a nozzle that promotes smooth laminar flow of the molten metal while minimizing turbulence.

SUMMARY OF THE INVENTION

The invention has met or exceeded the above mentioned needs as well as others. The nozzle for a caster defining a mold for casting molten metal into a metal product includes a mouthpiece portion for introducing the molten metal from the nozzle into the mold and further includes a baffle having a portion thereof disposed in the mouthpiece portion and a portion thereof extending into the mold. The baffle can have a cross-sectional shape that has a portion that diverges in the direction of molten metal flow and a portion that converges in the direction of molten metal flow.

A method of casting molten metal into a metal product in a caster having a mold is also provided which comprises providing a nozzle including a mouthpiece portion for introducing molten metal from the nozzle into the mold, effecting molten metal flow through the nozzle and physically interrupting that flow to create a smooth laminar flow of the molten metal. The physical interruption is effected by providing the baffle of the invention.

BRIEF DESCRIPTION OF THE DRAWINGS

A full understanding of the invention can be gained from the following description of the preferred embodiment when read in conjunction with the accompanying drawings in which.

DETAILED DESCRIPTION

As used herein, the term "metal product" means primarily clad or unclad strip or slab made substantially of one or more metals, including without limitation, aluminum and aluminum alloys and can also include, in a broader sense, clad or unclad bar, foil or rod.

Figure 1:
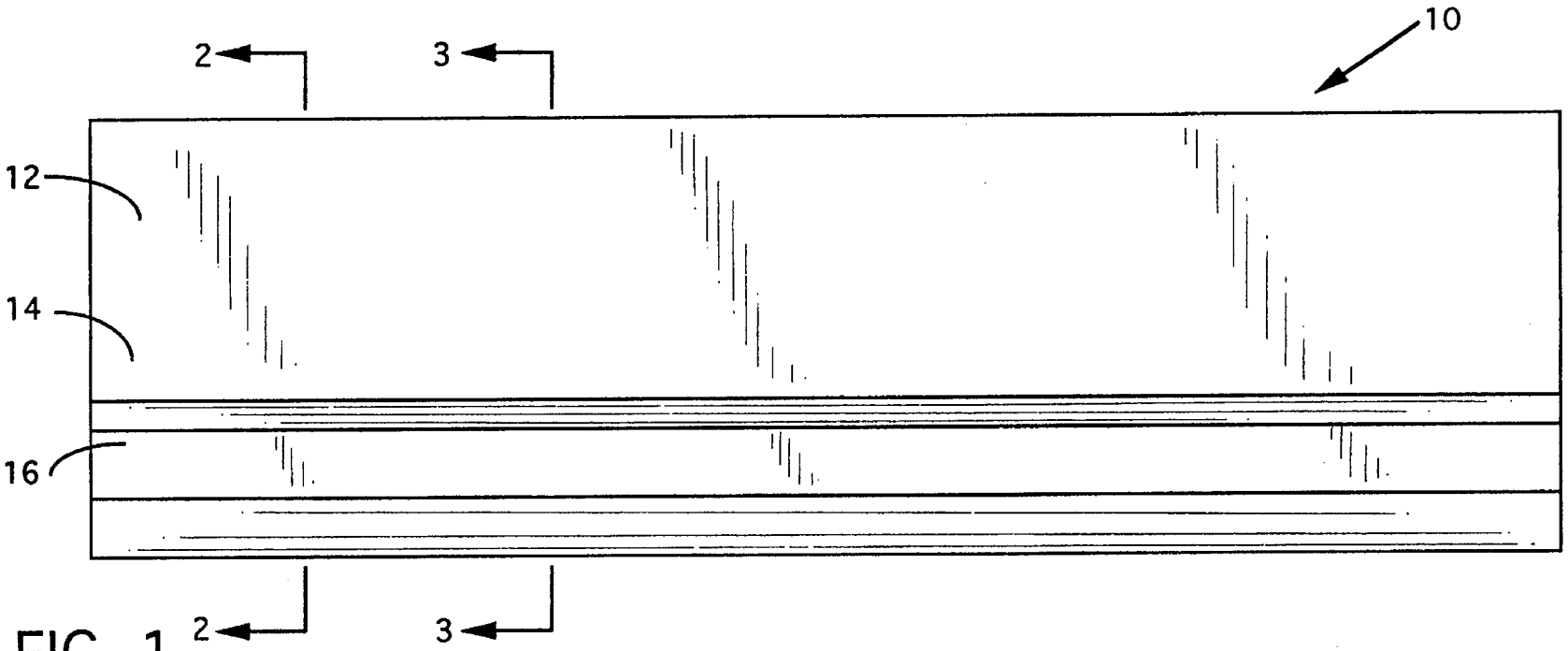
FIG. 1 is a front elevational view of the improved nozzle of the invention.
Figure 1A:
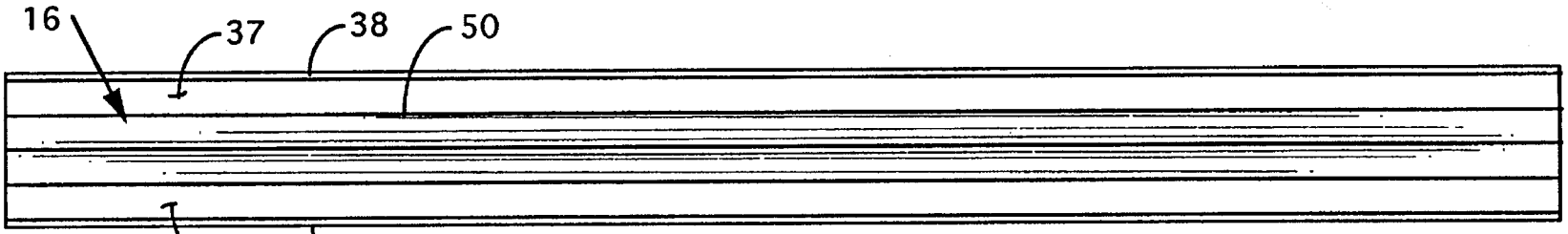
FIG. 1A is a bottom plan view of the improved nozzle of the invention.

Referring to FIGS. 1 and 1A, the improved nozzle of the invention is shown. The nozzle 10 includes a molten metal entry portion 12, a mouthpiece portion 14 and a baffle 16 having a portion thereof disposed in the mouthpiece portion 14. As can be seen, the baffle 16 extends over the entire length of the mouthpiece portion 14. The nozzle 10 receives molten metal, such as molten aluminum, from a tundish and delivers the molten metal into a mold of a caster. For example, the caster can be a vertical twin belt caster, which includes a pair of opposed movable belts and a pair of opposed side dams which together define a mold into which the molten metal is cast into a metal product, such as a slab, strip or bar. A representative vertical twin belt caster is disclosed in U.S. Pat. No. 4,964,456, the disclosure of which is expressly incorporated herein by reference. The molten metal is delivered from a furnace to the tundish and then flows through the tundish and into the nozzle 10. One type of nozzle arrangement is shown in U.S. Pat. No. 4,798,315, which is also expressly incorporated herein by reference. In that arrangement, the molten metal flows from the tundish into a plurality of tubes which communicate with the nozzle. It will be appreciated that other arrangements, such as providing opposed plates that define a passageway, can be used to transport the molten metal from the tundish to the nozzle.

The nozzle 10 is preferably made of a refractory material in order to handle the hot molten metal flowing therein. The nozzle 10 can be any desired length, height and width. The dimensions of the nozzle are dictated by several factors, most notably the dimension of the metal product to be cast.

Figure 2:
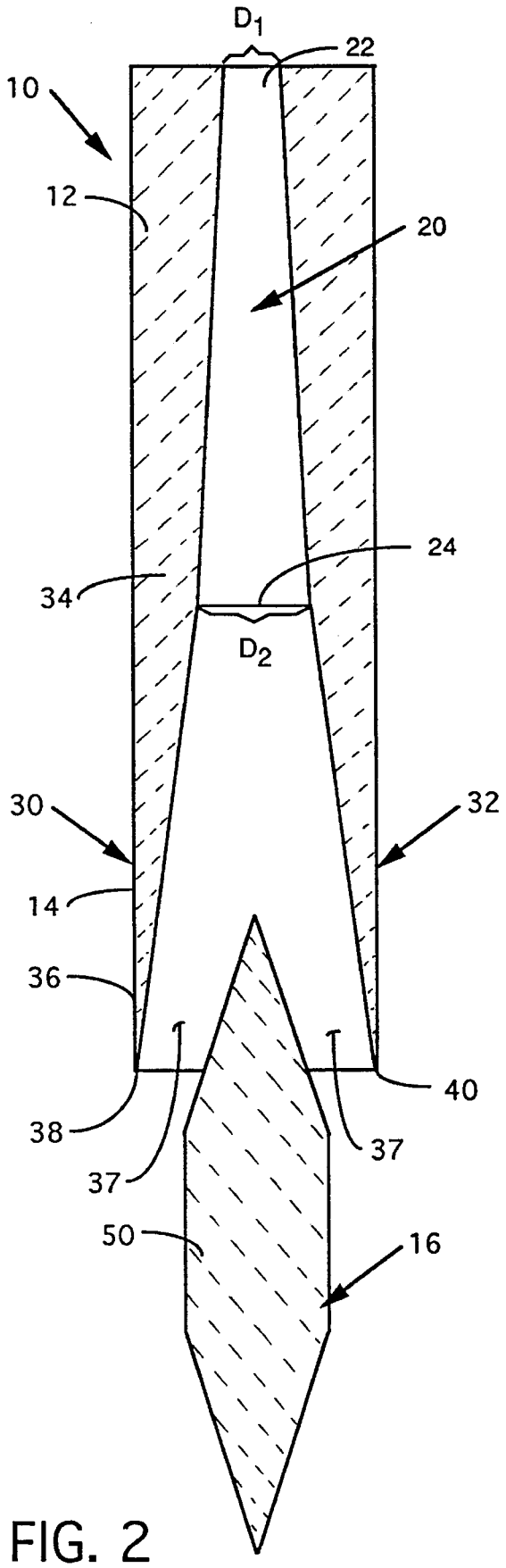
FIG. 2 is a cross-sectional view taken along line 2—2 of FIG. 1.
Figure 3:
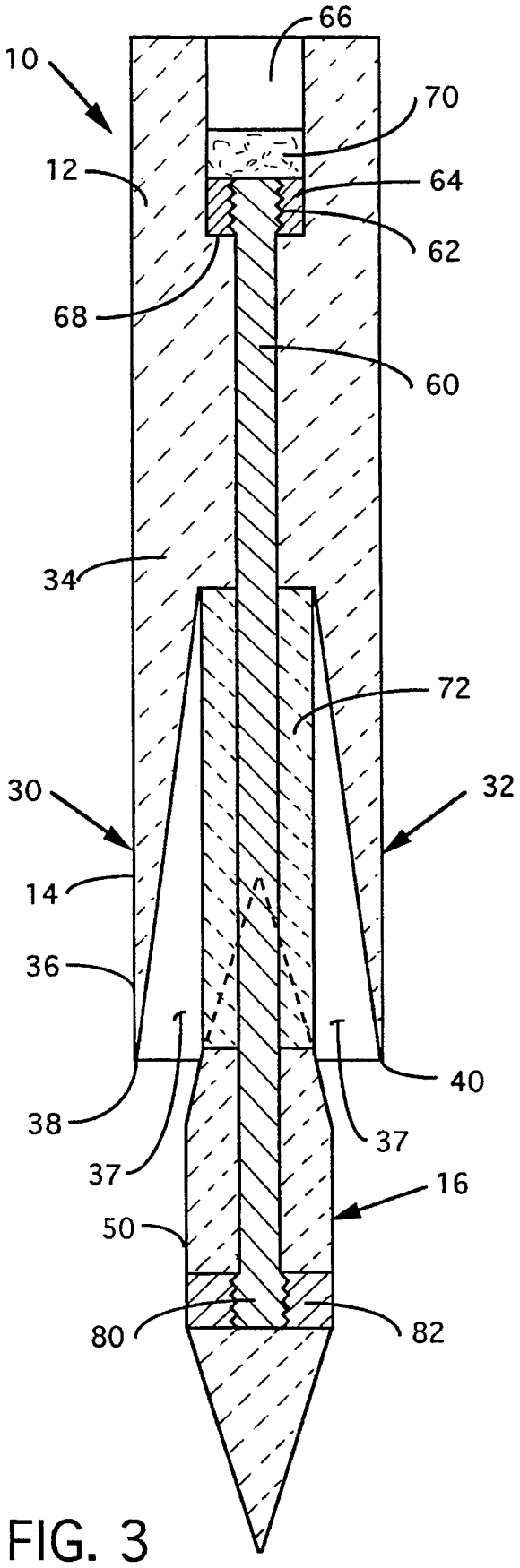
FIG. 3 is a cross-sectional view taken along line 3—3 of FIG. 1.
Figure 4:
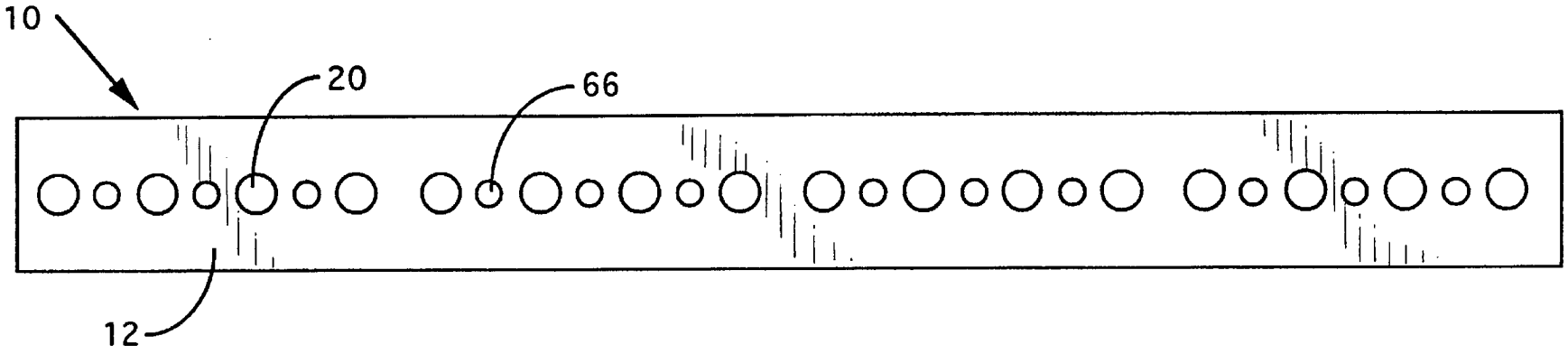
FIG. 4 is a top plan view of the improved nozzle of the invention.

Referring to FIGS. 2–4, it will be seen that the molten metal entry portion 12 includes a plurality (sixteen are provided, see FIG. 4) of passageways, which are preferably circular in cross-sectional shape. One such passageway, passageway 20, has a first opening 22 and a second opening 24 (FIG. 2). The first opening 22 is adapted to receive molten metal from a passageway (not shown) that in turn receives the molten metal from a tundish (also not shown). The diameter $D_1$, of the first opening 22 is less than the diameter $D_2$ at the second opening 24, and in fact, the passageway 20 tapers evenly in diameter from second opening 24 to first opening 22.

The mouthpiece portion 14 consists of a pair of opposed spaced walls 30 and 32. As can be seen in FIGS. 1 and 2, both the walls 30 and 32, such as wall 30, taper in cross-sectional thickness from a first end 34 adjacent to the molten metal entry portion 12 to a second end 36 which defines the opening 37 of the mouthpiece portion 14. Thus, the opening 37, where the molten metal is introduced from the mouthpiece 14 into the mold, is defined on either side by the tips 38 and 40 of the spaced walls 30 and 32, respectively.

FIGS. 2 and 3 show a cross-sectional view of the baffle 16 of the invention. The baffle 16 is also made of a refractory material and is shown as having a portion thereof disposed in the mouthpiece portion 14 and a portion thereof extending away from the mouthpiece portion and into the mold in which the molten metal is cast.

The baffle 16 has a generally diamond-shaped cross-section which acts to divert the molten metal laterally outwardly and then laterally inwardly as the molten metal exits through the mouthpiece portion 14 and into the mold of the caster. In this way, a smooth laminar flow of molten metal is created with a minimum of turbulence. This resists molten metal freezing to the tips 38, 40 of the nozzle 10 and enhances the quality of the cast metal product. As can be seen in FIGS. 2 and 3, the baffle 16 can include an intermediate portion 50 between the diverging and converging regions. The intermediate portion can have a rectangular cross-section as shown in FIGS. 2 and 3.

The baffle 16 is secured to the nozzle 10 by a plurality of mechanical fastening means. One such mechanical fastening means is threaded shaft 60 shown in FIG. 3. The threaded shaft 60, preferably made of metal, has a first threaded end 62 with a nut 64 secured thereto that is countersunk in the molten metal entry portion 12. The opening 66 into which the threaded shaft 60 and nut 62 are countersunk is preferably circular (see FIG. 4) and has an annular shoulder 68 which contacts the nut 62 in order to support the threaded shaft 60 and the baffle 16 from the nozzle 10. A refractory material 70 is filled on top of the threaded shaft 60 and nut 62 in the opening 66 in order to protect the threaded shaft 60 and nut 62 from molten metal that may leak from the tubes leading into nozzle 10 which may then flow into the opening 66.

The threaded shaft 60 extends through the molten metal entry portion 12 and into the mouthpiece portion 14. In order to protect the threaded shaft 60 from molten metal in the mouthpiece portion 14, the threaded shaft 60 is surrounded by a refractory tube 72. The threaded shaft 60 then extends into the baffle 16 and terminates at a second threaded end 80. Attached to this second threaded end 80 is an anchor 82 that is threaded onto the second threaded end 80 in order to secure the threaded shaft 60 to the baffle 16 and thus support the baffle 16 from the nozzle 10. The anchor 82 can also be cemented into the baffle.

The method of casting molten metal into a metal product in a caster having a mold comprises providing a nozzle 10 including a mouthpiece portion 14 for introducing molten metal from the nozzle 10 into the mold, effecting molten metal flow through the nozzle 10 and physically interrupting that flow by employing a baffle 16 having a portion thereof disposed in the mouthpiece portion 14 and a portion thereof extending into the mold to create a smooth laminar flow of the molten metal. The physical interruption is effected by providing the baffle 16 of the invention.

It will be appreciated that an improved nozzle for a caster has been disclosed which includes a baffle in order to create a smooth laminar flow of molten metal in the nozzle and the mold. This smooth laminar flow resists freezing of molten metal to the nozzle as well as enhancing the quality of the cast metal product. An associated method of casting a molten metal in a mold of a caster has also been disclosed.

While specific embodiments of the invention have been disclosed, it will be appreciated by those skilled in the art that various modifications and alterations to those details could be developed in light of the overall teachings of the disclosure. Accordingly, the particular arrangements disclosed are meant to be illustrative only and not limiting as to the scope of the invention which is to be given the full breadth of the appended claims and any and all equivalents thereof.

What is claimed is:

1. A nozzle for a caster having a mold for casting molten metal into a metal product, said nozzle including a molten metal entry portion and a mouthpiece portion, said molten metal flowing in a direction from said molten metal entry portion, through said mouthpiece portion and into said mold, said nozzle further including a baffle secured to said nozzle by a plurality of shafts having a first end secured to said molten metal entry portion and a second end secured to said baffle, said shafts being disposed in a manner that is generally parallel to said Flow direction of said molten metal.

2. The nozzle of claim 1, wherein said baffle has a cross-sectional shape that has a portion that diverges in said molten metal flow direction and a portion that converges in said molten metal flow direction.

3. The nozzle of claim 2, wherein said baffle has a generally diamond-shaped cross-section.

4. The nozzle of claim 3, wherein said diamond-shaped cross-section includes a rectangularly-shaped portion intermediate said diverging and converging portions.

5. The nozzle of claim 1, wherein said second end is secured to an anchor, said anchor securing said shaft to said baffle.

6. The nozzle of claim 5 wherein said first end is threaded and receives a nut which secures said shaft to said nozzle.

7. The nozzle of claim 6, wherein said shaft is surrounded by a refractory tube so that said molten metal does not contact said shaft.

8. The nozzle of claim 1, wherein said molten metal entry portion includes a plurality of passageways having a first end portion which communicates with said mouthpiece portion and a second end portion opposite said first end where said molten metal enters said molten metal entry portion.

9. The nozzle of claim 8, wherein said passageways are generally circular.

10. The nozzle of claim 9, wherein said passageways vary in diameter over their length.

11. The nozzle of claim 10, wherein said diameter of said passageway is greater at said first end portion than at said second end portion.

12. The nozzle of claim 11, wherein said diameter tapers evenly from said second end portion to said first end portion.

13. The nozzle of claim 8, wherein said mouthpiece portion includes a first wall secured to said molten metal entry portion and an opposed second wall secured to said molten metal entry portion;

said first wall and said second wall define an opening where said molten metal is introduced into said mold; and said first wall and said second wall both taper in cross-sectional thickness from said molten metal entry portion to said opening.

14. The nozzle of claim 1, wherein said baffle extends over the entire width of said mouthpiece portion in a transverse direction.

15. The nozzle of claim 1, wherein said nozzle is made of a refractory material.

16. The nozzle of claim 1, wherein said baffle is made of a refractory material.

* * * * *